US010851590B2

(12) United States Patent
Glover et al.

(10) Patent No.: US 10,851,590 B2
(45) Date of Patent: Dec. 1, 2020

(54) AUTOMATED DRILL CONTROL SYSTEM FOR A MOBILE DRILLING MACHINE

(71) Applicant: Caterpillar Global Mining Equipment LLC, Denison, TX (US)

(72) Inventors: Rex Glover, Deer Creek, IL (US); Ahsan Shahid, Peoria, IL (US); Hyppolite Kuissi, Peoria, IL (US)

(73) Assignee: Caterpillar Global Mining LLC, Tucson, AZ (US)

( * ) Notice: Subject to any disclaimer, the term of this patent is extended or adjusted under 35 U.S.C. 154(b) by 195 days.

(21) Appl. No.: 16/204,529

(22) Filed: Nov. 29, 2018

(65) Prior Publication Data

US 2020/0173234 A1 Jun. 4, 2020

(51) Int. Cl.

| | |
|---|---|
| ***E21B 44/00*** | (2006.01) |
| ***E21B 7/02*** | (2006.01) |
| ***E21B 41/00*** | (2006.01) |
| ***G05G 9/047*** | (2006.01) |
| *E21B 3/02* | (2006.01) |
| *E21B 19/084* | (2006.01) |

(52) U.S. Cl.

CPC ..... *E21B 7/022* (2013.01); *E21B 41/00* (2013.01); *G05G 9/047* (2013.01); *E21B 3/02* (2013.01); *E21B 7/027* (2013.01); *E21B 19/084* (2013.01); *E21B 44/00* (2013.01); *G05G 2009/04774* (2013.01)

(58) Field of Classification Search

CPC . E21B 7/002; E21B 41/00; E21B 3/02; E21B 7/027; E21B 19/084; E21B 7/02; E21B 44/00; G05D 1/0016; G05D 1/0022; G05G 9/047; G05G 2009/04774; E02D 17/13; E02F 9/16; B60N 2/46

See application file for complete search history.

(56) References Cited

U.S. PATENT DOCUMENTS

| | | | | |
|---|---|---|---|---|
| 6,029,951 | A | 2/2000 | Guggari | |
| 6,446,738 | B1 * | 9/2002 | Boyd | B62D 33/06 175/122 |
| 6,629,572 | B2 | 10/2003 | Womer et al. | |
| 8,033,345 | B1 | 10/2011 | Randall et al. | |
| 9,057,221 | B2 * | 6/2015 | Warr | E21B 7/02 |
| 9,810,053 | B2 | 11/2017 | Mercer | |
| 2014/0343754 | A1 | 11/2014 | Poettker et al. | |
| 2017/0284162 | A1 | 10/2017 | Schober et al. | |
| 2018/0363443 | A1 * | 12/2018 | Guertin | E21B 19/15 |

* cited by examiner

*Primary Examiner* — Yong-Suk (Philip) Ro
(74) *Attorney, Agent, or Firm* — Bookoff McAndrews

(57) ABSTRACT

A mobile drilling machine may include a drilling mast including a mast frame. The mobile drilling machine may further include a rotary head movably mounted on the mast frame, the rotary head controllable to rotate a drill string at a desired drill string rotation speed. The rotary head may further be controllable to move up and down the mast frame at a desired drill string feed speed. Additionally, the mobile drilling machine may include a joystick movable to control the desired drill string rotation speed and the desired drill string feed speed of the rotary head. A controller of the mobile drilling machine may be configured to receive a current desired drill string rotation speed and drill string feed speed information from the joystick and lock the current desired drill string rotation speed and the desired drill string feed speed upon activation of a switch mechanism.

20 Claims, 4 Drawing Sheets

AUTOMATED DRILL CONTROL SYSTEM FOR A MOBILE DRILLING MACHINE

TECHNICAL FIELD

The present disclosure relates generally to mobile drilling machines, and more particularly, to a drill control system for such machines.

BACKGROUND

Mobile drilling machines, such as blasthole drilling machines, are typically used for drilling blastholes for mining, quarrying, dam construction, and road construction, among other uses. The process of excavating rock, or other material, by blasthole drilling comprises using the blasthole drill machine to drill a plurality of holes into the rock and filling the holes with explosives. The explosives are detonated causing the rock to collapse and rubble of the collapse is then removed and the new surface that is formed is reinforced. Many current blasthole drilling machines utilize rotary drill rigs, mounted on a mast, that can drill blastholes anywhere from 6 inches to 22 inches in diameter and depths up to 180 feet or more.

Blasthole drilling machines may include input devices, such as one or more joysticks, for controlling the machine during a drilling operation. The one or more joysticks may control drilling commands, such as rotation speed and feed speed of a drill string for rotating a drill bit to drill into the ground surface. The rotation speed and feed speed commands may need to be used for an extended amount of time during the drilling operation. As such, an operator may be required to maintain a joystick position for an extended period in order to maintain a desired drill string rotation speed and feed speed. Many blasthole drilling machines utilize joysticks with friction packs to assist in maintain drilling commands during the drilling operation. However, joysticks with friction packs are unreliable, expensive, and do not reset via software for remote operation.

U.S. Pat. No. 6,029,951, issued to Guggari on Feb. 29, 2000 ("the '951 patent"), describes a typical spring-driven movement control joystick for an oil well drilling rig. The movement control joystick of the '951 patent can be pushed into a "PARK" position and mechanically held there. However, the "PARK" position of the '951 patent does not provide flexibility in controlling the driving of the drill.

The systems and methods of the present disclosure may address or solve one or more of the problems set forth above and/or other problems in the art. The scope of the current disclosure, however, is defined by the attached claims, and not by the ability to solve any specific problem.

SUMMARY

A mobile drilling machine is disclosed. The mobile drilling machine may include a drilling mast including a mast frame; a rotary head movably mounted on the mast frame, the rotary head controllable to rotate a drill string at a desired drill string rotation speed, wherein the rotary head is further controllable to move up and down the mast frame at a desired drill string feed speed; a joystick movable to control the desired drill string rotation speed and the desired drill string feed speed of the rotary head; and a controller configured to: receive a current desired drill string rotation speed and drill string feed speed information from the joystick; and lock the current desired drill string rotation speed and the desired drill string feed speed upon activation of a switch mechanism.

A method of controlling a rotary head of a mobile drilling machine to rotate a drill string at desired drill string rotation speeds and to move the rotary head up and down a mast frame at desired drill string feed speeds, the method comprising: receiving a current desired drill string rotation speed and drill string feed speed information from a joystick of the mobile drilling machine; and locking the current desired drill string rotation speed and the desired drill string feed speed upon activation of a switch mechanism.

A mobile drilling machine, comprising: a drilling mast including a mast frame; a rotary head movably mounted on the mast frame, the rotary head controllable to rotate a drill string at desired drill string rotation speeds, wherein the rotary head is further controllable to move up and down the mast frame at desired drill string feed speeds; a joystick movable to control the desired drill string rotation speeds and the desired drill string feed speeds of the rotary head, wherein the joystick is movable in a left and right direction corresponding to an x-axis and movable in a forward and backward direction corresponding to a y-axis; and a controller configured to: receive a current desired drill string rotation speed and drill string feed speed information from the joystick; and lock the current desired drill string rotation speed and the desired drill string feed speed upon activation of a switch mechanism, wherein when locked, the drill string rotation speed and drill string feed speed remain at the locked current desired drill string rotation speed and the desired drill string feed speed if the joystick is returned to a neutral position, and wherein when locked, the drill string rotation speed is selectively increased or decreased by moving the joystick along the one of the x-axis or y-axis, and the drill string feed speed is selectively increased, stopped, or reversed by moving the joystick along the other of the x-axis or y-axis.

BRIEF DESCRIPTION OF THE DRAWINGS

The accompanying drawings, which are incorporated in and constitute a part of this specification, illustrate various exemplary embodiments and together with the description, serve to explain the principles of the disclosure.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% in a stated value.

Figure 1:
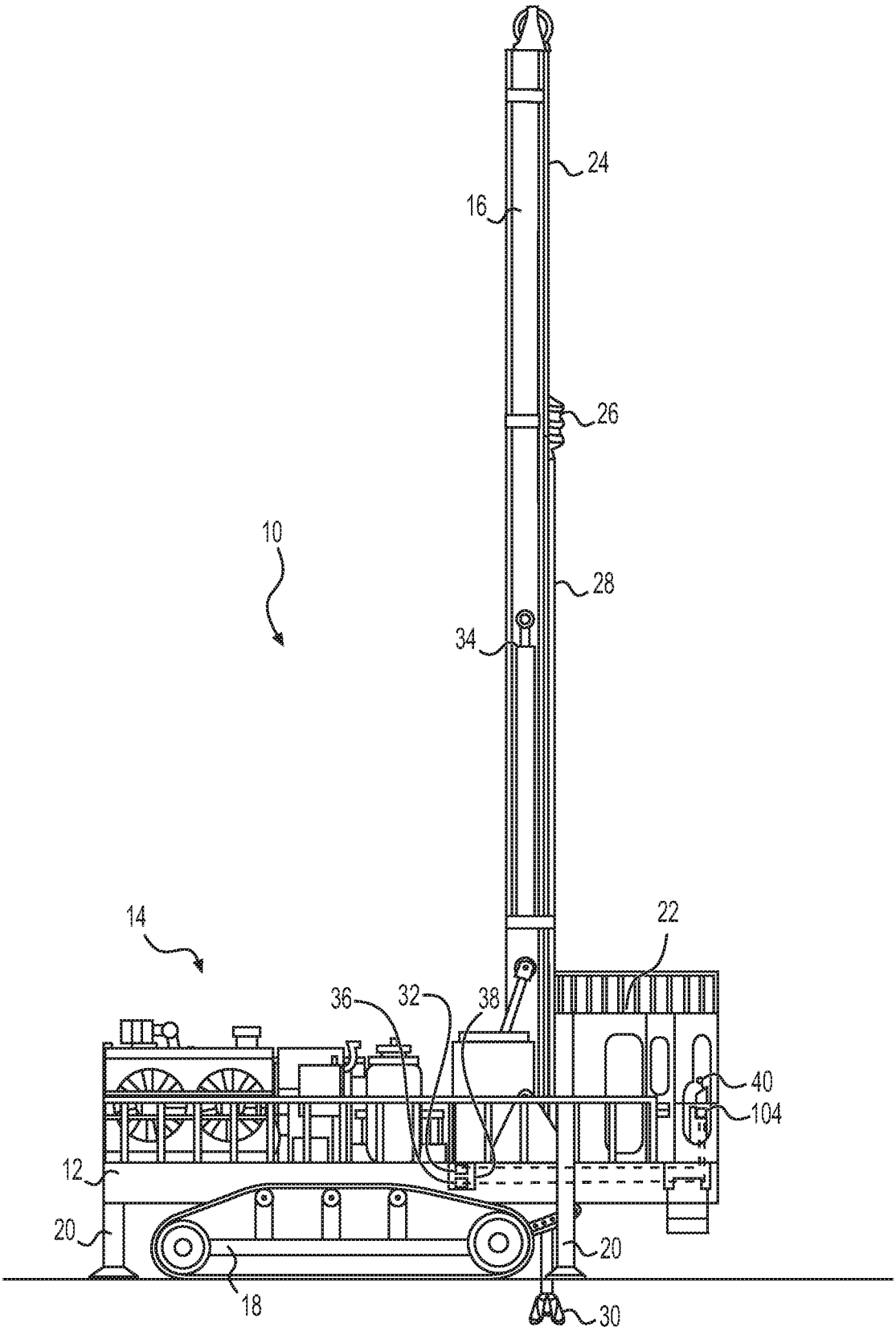
FIG. 1 illustrates a schematic side view of a drilling machine with an exemplary drill control system, according to aspects of the disclosure.

FIG. 1 illustrates a schematic side view of an exemplary drilling machine 10. The disclosure herein may be applicable to any type of drilling machine, however, reference will be made below particularly to a mobile blasthole drilling machine. As shown in FIG. 1, mobile drilling machine 10 may include a frame 12, machinery 14, and a drilling mast 16. Frame 12 may be supported on a ground surface by a transport mechanism, such as crawler tracks 18. Crawler tracks 18 may allow mobile drilling machine 10 to maneuver about the ground surface to a desired location for a drilling operation. Frame 12 may further include one or more jacks 20 for supporting and leveling mobile drilling machine 10 on the ground surface during the drilling operation. Frame 12 may support the machinery 14, which may include engines, motors, batteries, pumps, air compressors, a hydraulic fluid storage tank 36 (shown schematically in FIG. 1) and/or any other equipment necessary to power and operate mobile drilling machine 10. Frame 12 may further support an operator cab 22, from which a user, or operator, may maneuver and control mobile drilling machine 10.

As further shown in FIG. 1, drilling mast 16 may include a mast frame 24 which may support a drill motor assembly, or rotary head 26, movably mounted on the mast frame 24. Rotary head 26 may couple to, and may be controllable to rotate, a drill string 28 of drilling pipe segments on which a drill bit 30 is mounted for drilling into the ground surface, as further described below. Rotary head 26 may be any type of rotary head, such as a hydraulic rotary head or the like. Rotary head 26 may further include a hydraulic fluid line (not shown) for receiving hydraulic fluid. The hydraulic fluid may be used to rotate a shaft of rotary head 26 on which the drill string 28 is connected for rotating the drill string 28 (and thus rotating drill bit 30). The hydraulic fluid lines of rotary head 26 may be coupled to hydraulic valves 32 (shown schematically in FIG. 1) for controlling the amount, and flow rate, of the hydraulic fluid into and out of rotary head 26. In the exemplary embodiment, hydraulic valves 32 may be located adjacent the hydraulic fluid storage tank 38. However, hydraulic valves 32 may be located anywhere along the hydraulic fluid lines of the rotary head 26, as necessary.

Drilling mast 16 may further include a hydraulic cylinder 34 (located within mast frame 24) connected to rotary head 26 via a cable and pulley system (not shown) for moving rotary head 26 up and down along the mast frame 24. In one exemplary system, when hydraulic cylinder 34 is extended, rotary head 26 may be pulled-down along mast frame 24 and when hydraulic cylinder 34 is retracted, rotary head 26 may be hoisted up along mast frame 24. Thus, rotary head 26 may be controllable to move up and down the mast frame 24 such that drill bit 30 on drill string 28 may be pulled-down towards, and into, the ground surface or hoisted up from the ground surface. Hydraulic cylinder 34 may include hydraulic fluid lines (not shown) for receiving and exiting hydraulic fluid. The hydraulic fluid may be used to actuate hydraulic cylinder 34 such that a rod of hydraulic cylinder 34 may be extended or retracted. The hydraulic fluid lines of hydraulic cylinder 34 may be coupled to hydraulic valves 36 (shown schematically in FIG. 1) for controlling the amount, and flow rate, of the hydraulic fluid into and out of the hydraulic cylinder 34. In the exemplary embodiment, hydraulic valves 36 may be located on the hydraulic fluid storage tank 38. However, hydraulic valves 36 may be located anywhere along the hydraulic fluid lines of the hydraulic cylinder 34, as necessary. It is understood that hydraulic fluid may be any type of hydraulic fluid, such as hydraulic oil or the like.

Operator cab 22 may include an input device, such as one or more joysticks 40, for controlling various functions of the mobile drilling machine 10. The one or more joysticks 40 may be located anywhere in operator cab 22 (or otherwise on mobile drilling machine 10), such as coupled to an operator seat or a control panel. The one or more joysticks 40 may include one such joystick 40 to allow the operator to control the rotation speed and feed speed of drill string 28, as further described below. The joystick 40 may be in communication with a controller 104 to receive inputs and control outputs of the mobile drilling machine 10. In the exemplary embodiment, controller 104 may be located in operator cab 22. However, controller 104 may be located anywhere on mobile drilling machine 10. Controller 104 may further be in communication with the controlling elements of rotary head 26 and hydraulic cylinder 34, such as hydraulic valves 32 of rotary head 26 and the hydraulic valves 36 of hydraulic cylinder 34. It is understood that the input devices controlling drilling machine 10 are not limited to one or more joysticks 40, but may additionally include any type of input device, such as a control wheel, a touch screen user interface, or any other equipment or device for providing control signals to controller 104.

Figure 2:
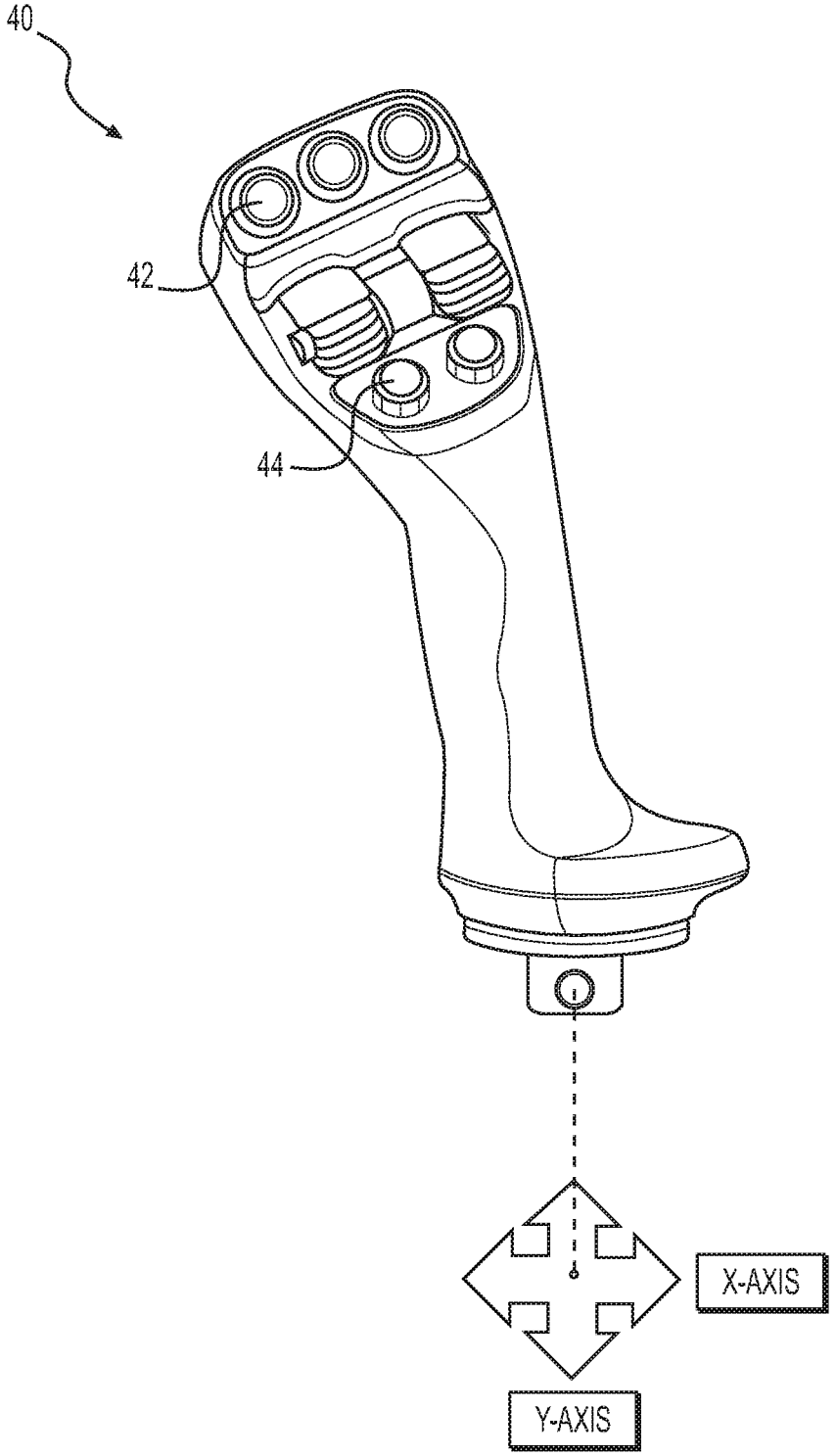
FIG. 2 illustrates a perspective view of a joystick isolated from the mobile drilling machine of FIG. 1.

FIG. 2 illustrates an exemplary joystick 40 of the mobile drilling machine 10. As discussed above, the one or more joysticks 40 may allow a user, or operator, to control various functions of mobile drilling machine 10. As such, joystick 40 may include a plurality of switch mechanisms 42 and movements for sending various command signals to controller 104. The plurality of switch mechanisms 42 may include buttons, switches, touch screen icons, or the like. Each switch mechanism 42 and movement may be configured to control a different function of mobile drilling machine 10. Joystick 40 may further be configured for movement along an x-axis and a y-axis in a two-dimensional Cartesian coordinate system, such that the y-axis may be orthogonal to the x-axis. Thus, joystick 40 may include an x-coordinate and a y-coordinate. As used herein, the x-axis is defined by joystick 40 moving in a left or right direction and the y-axis is defined by the one or more joysticks 40 moving in a forward or backward direction with respect to an operator sitting in the operator seat. Joystick 40 may also include a neutral position which may be defined at coordinates (0,0) of the x-axis and y-axis. Joystick 40 may be spring-loaded such that joystick 40 automatically returns to the neutral position when the operator releases joystick 40. Joystick 40 may further be movable in and around any quadrant formed by the x-axis and y-axis of the two-dimensional Cartesian coordinate system for controlling different functions of mobile drilling machine 10 at any one time.

Joystick 40 may further be configured for a plurality of different operation modes such that the plurality of switch mechanisms 42 and movement of the joystick 40 control different functions in each of the different operation modes. In the exemplary embodiment, the joystick 40 may be configured for three different drill modes and a tram mode. However, any number of drill modes or other modes may be used as necessary. In a first drill mode, the joystick 40 and the plurality of switch mechanisms 42 may control a first set of functions of mobile drilling machine 10. In a second drill mode, the joystick 40 and the plurality of switch mechanisms 42 may control a second set of functions of mobile drilling machine 10. In a third drill mode, the joystick 40 and the plurality switch mechanisms 42 may control a third set of functions of mobile drilling machine 10, and so forth. In the tram mode, the joystick 40 and the plurality of switch mechanisms 42 may control movement of mobile drilling machine 10 along the ground surface. In at least one of the drill modes, joystick 40 may include a lock switch mechanism 44 for locking a desired setting of one or more functions of mobile drilling machine 10, as further described below.

Figure 3:
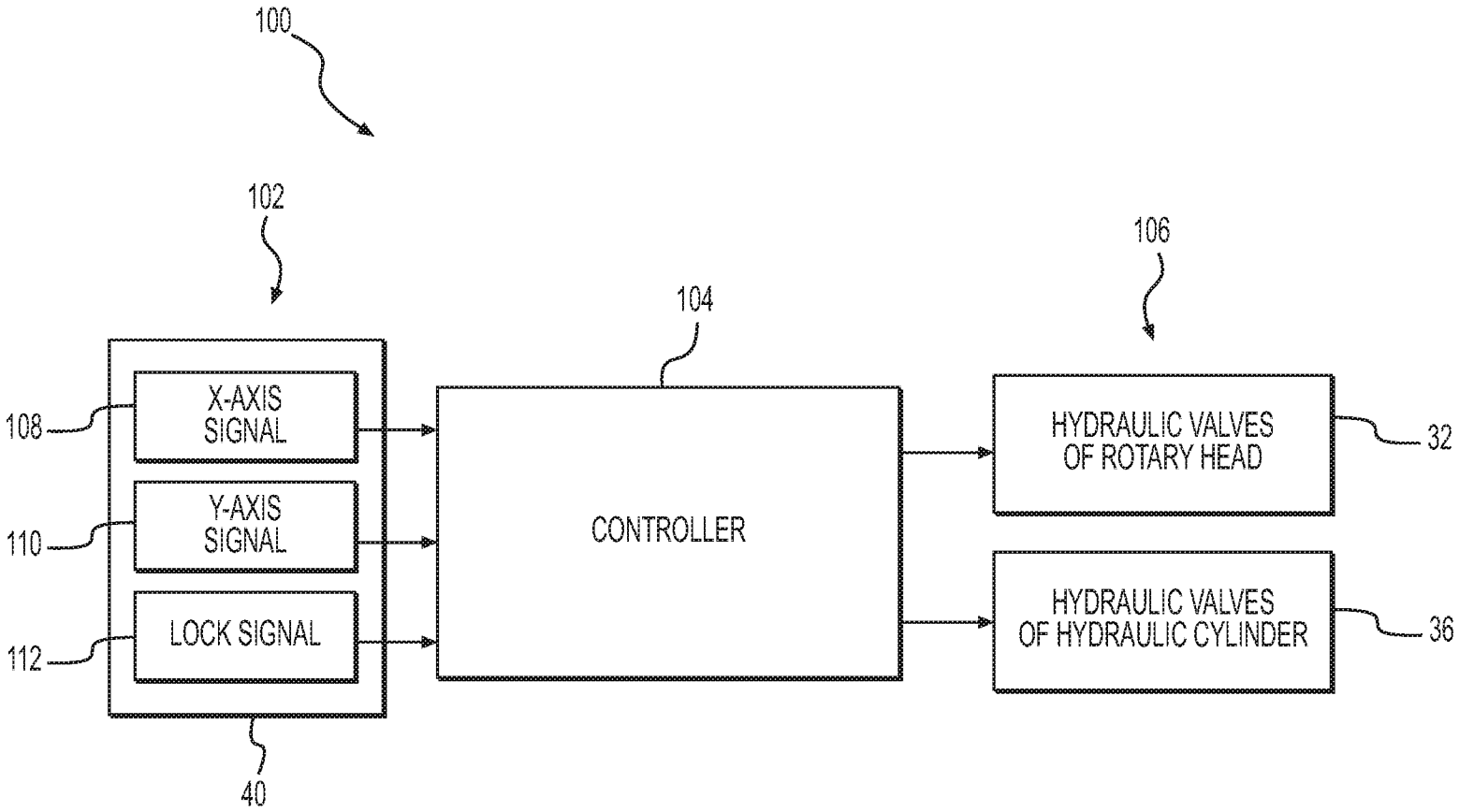
FIG. 3 illustrates a schematic view of the exemplary drill control system of the mobile drilling machine of FIG. 1.

FIG. 3 illustrates a schematic view of a drill lock control system 100 of mobile drilling machine 10 for operation and/or control of at least portions of mobile drilling machine 10. Control system 100 may include inputs 102, controller 104, and outputs 106. Inputs 102 may include, for example, signals from joysticks 40 such as an x-axis signal 108, a y-axis signal 110, and a lock signal 112. Outputs 106 may include, for example, the hydraulic valves 32 of rotary head 26 for controlling rotation speed of drill string 28 and the hydraulic valves 36 of hydraulic cylinder 34 for controlling feed speed of the drill string 28. As used herein, drill string 28 rotation speed is defined as the rotational speed at which rotary head 26 is controlled to rotate drill string 28. Further, drill string 28 feed speed is defined as the speed and direction in which rotary head 26 is controlled to move drill string 28 up and down mast frame 24. It is understood that inputs 102 may include signals from any of the plurality of switch mechanisms 42 and outputs 106 may include any corresponding function of mobile drilling machine 10. Further, while rotary head 26 and hydraulic cylinder 34 are described herein as being controlled by control valves (32, 36), this is exemplary only, and it is understood that any other (or additional) appropriate control mechanism can be used to control rotary head 26 and hydraulic cylinder 34.

Controller 104 may embody a single microprocessor or multiple microprocessors that may include means for setting, locking, and modifying a desired drill string 28 rotation speed and drill string 28 feed speed of rotary head 26. For example, controller 104 may include a memory, a secondary storage device, a processor, such as a central processing unit or any other means for accomplishing a task consistent with the present disclosure. The memory or secondary storage device associated with controller 104 may store data and/or software routines that may assist controller 104 in performing its functions. Further, the memory or secondary storage device associated with controller 104 may also store data received from the various inputs 102 associated with mobile drilling machine 10. Numerous commercially available microprocessors can be configured to perform the functions of controller 104. It should be appreciated that controller 104 could readily embody a general machine controller capable of controlling numerous other machine functions. Various other known circuits may be associated with controller 104, including signal-conditioning circuitry, communication circuitry, hydraulic or other actuation circuitry, and other appropriate circuitry.

Controller 104 may be in communication with joystick 40. The x-axis signal 108 may correspond to a x-axis position of joystick 40. The x-axis position of joystick 40 may include left, right, or neutral positions. For example, the neutral position of joystick 40 may be at a center position, such that the x-axis signal 108 may include (x=0). From the neutral position, joystick 40 may be moved left or right along the x-axis and the x-axis signal 108 may include a current x-axis position of joystick 40. Similarly, the y-axis signal 110 may correspond to a y-axis position of the joystick 40. The y-axis position of joystick 40 may include forward, backward, or neutral positions. For example, the neutral position of joystick 40 may be at a center position, such that the y-axis signal 110 may include (y=0). From the neutral position (0,0), joystick 40 may be moved forward or backward along the y-axis and the y-axis signal 110 may include a current y-axis position of joystick 40. Lock signal 112 may correspond to a signal from lock switch mechanism 44 that may include a command for locking a desired setting of one or more functions of mobile drilling machine 10, as further detailed below. The x-axis and y-axis signals may be generated by any appropriate joystick position sensing mechanism, such as hall effect sensor mechanisms.

In the exemplary embodiment, in a first drill mode, the x-axis signal 108 may include a command for the rotary head 26 to rotate the drill string 28 forward or reverse based on one of the x-axis position of the joystick 40. For example, when the joystick 40 is moved left or right along the x-axis, controller 104 may receive the x-axis signal 108 with the x-axis position information. Based on the x-axis position information in the x-axis signal 108, controller 104 may actuate or otherwise control hydraulic valves 32 of rotary head 26, such that rotary head 26 may rotate drill string 28 forward or reverse (i.e., clockwise or counterclockwise) at a desired drill string 28 rotation speed. In the exemplary embodiment, when the joystick 40 is moved left from the neutral position, controller 104 may control hydraulic valve 32 of rotary head 26 to rotate the drill string 28 forward. Likewise, when the joystick 40 is moved right from the neutral position, controller 104 may control hydraulic valve 32 of rotary head 26 to rotate the drill string 28 reverse.

In the exemplary embodiment, in the first drill mode, the y-axis signal 110 may include a command for pulling-down or hoisting up the rotary head 26 based on the y-axis position of the joystick 40. For example, when the joystick 40 is moved forward or backward along the y-axis, controller 104 may receive the y-axis signal 110 with the y-axis position information. Based on the y-axis position information in y-axis signal 110, controller 104 may actuate or otherwise control hydraulic valve 36 of hydraulic cylinder 34, such that the rotary head 26 may be pulled-down or hoisted up (via the cable and pulley system) along mast frame 24 at a desired drill string 28 feed speed. In the exemplary embodiment, when the joystick 40 is moved backward from the neutral position, controller 104 may control hydraulic valves 36 of hydraulic cylinder 34 to pull-down rotary head 26. Likewise, when the joystick 40 is moved forward from the neutral position, controller 104 may control hydraulic valves 36 of hydraulic cylinder 34 to hoist up rotary head 26.

It is understood that any orientation of movement of joystick 40 may be used to control hydraulic valves 32, 36 for controlling desired drill string 28 rotation speeds and desired drill string 28 feed speeds of rotary head 26. For example, desired drill string 28 rotation speed may be selectable by moving the joystick 40 along either one of the x-axis or the y-axis (e.g., left/right or forward/backward). Likewise, the desired drill string 28 feed speed and direction may be selectable by moving the joystick 40 along the other of the x-axis or the y-axis (e.g., left/right or forward/backward). Further, joystick 40 may be used to control multiple functions of drilling machine 10 at one time. For example, when joystick 40 is moved into a quadrant of the Cartesian coordinate system (such that joystick 40 includes a non-zero x-coordinate and y-coordinate), controller 104 may control hydraulic valves 32 of rotary head 26 and hydraulic valves 36 of hydraulic cylinder 34 at one time to modify rotation speed and feed speed at the same time.

Lock signal 112 may include a command for controller 104 to lock a current desired drill string 28 rotation speed and a current desired drill string 28 feed speed. Lock signal 112 may be sent to controller 104 upon a first activation of the lock switch mechanism 44, such that the joystick 40 is set to a drill lock mode. In the drill lock mode, the drill string 28 rotation speed and drill string 28 feed speed may remain at the locked current desired drill string 28 rotation speed and current desired drill string 28 feed speed even if and when the joystick 40 is returned to the neutral position. Further, in the drill lock mode, the x-axis signal 108 and the y-axis signal 110 may correspond to different commands for controller 104. The drill lock mode may be terminated (i.e., ended) by any appropriate means, such as upon a second activation of the lock switch mechanism 44.

In the drill lock mode, the drill string 28 rotation speed may be selectively increased or decreased by moving the respective joystick 40 along one of the x-axis or y-axis. For example, the drill string 28 rotation speed may be increased or decreased by moving the joystick 40 in the left or right direction along the x-axis. In the exemplary embodiment, the drill string 28 rotation speed may be increased by moving the joystick 40 left (i.e., a first direction) and may be decreased by moving the joystick 40 right (i.e., a second direction).

Similarly, the drill string 28 feed speed may be selectively increased, stopped, or reversed by moving the respective joystick 40 along the other of the x-axis or y-axis. For example, the drill string 28 feed speed may be increased, stopped, or reversed by moving the joystick 40 in the forward or backward direction along the y-axis. In the exemplary embodiment, the drill string 28 feed speed may be increased by moving the joystick 40 backward (i.e., a third direction) and may be stopped or reversed by moving the joystick 40 forward (i.e., a fourth direction). In one embodiment, the drill string 28 feed speed (pull-down or hoist up) may be increased by moving the joystick 40 in the same direction of the current drill string 28 feed direction and may be stopped or reversed by moving the joystick 40 in the opposite direction of the current drill string 28 feed direction. For example, if the drill string 28 is being pulled-down when the lock switch mechanism is activated, the drill string 28 pull-down speed may be increased by moving the joystick 40 backward. In the current example, if the joystick 40 is moved forward, the drill string 28 may stop being pulled-down and if the joystick 40 is moved forward again, the drill string 28 may be hoisted up. Likewise, while the drill string 28 is being hoisted up, the drill string 28 hoist up speed may be increased by moving the joystick 40 forward. If the joystick 40 is moved backward, the drill string 28 may stop being hoisted up and if the joystick 40 is moved backward again, the drill string 28 may be pulled-down.

In one embodiment, drill string 28 rotation speed may be selectively increased or decreased in incremental steps when the joystick 40 is moved along one of the x-axis or y-axis. Similarly, drill string 28 feed speed may be selectively increased, stopped, or reversed in incremental steps when the joystick 40 is moved along the other of the x-axis or y-axis. For example, if the joystick 40 is moved along the one of the x-axis or y-axis once, the drill string 28 rotation speed may be increased or decreased by one incremental step. If the joystick 40 is moved along the other of the x-axis or y-axis once, the drill string 28 feed speed may be increased, stopped, or reversed by one incremental step. A size of the incremental step may be based on a percentage that the joystick 40 is moved along the x-axis or y-axis. For example, if the joystick 40 is moved between 0-90% of a maximum allowable movement, the incremental step may be small, such that drill string 28 rotation speed or drill string 28 feed speed is increased or decreased by a small amount. If the joystick 40 is moved between 91-100% of the maximum allowable movement, the incremental step may be large, such that drill string 28 rotation speed or drill string 28 feed speed may be increased or decreased by a larger amount.

It is understood that any orientation of movement of joystick 40 may be used to control hydraulic valves 32, 36 for controlling desired drill string 28 rotation speeds and desired drill string 28 feed speeds of rotary head 26 while in the drill lock mode. For example, desired drill string 28 rotation speed may be increased or decreased by moving the joystick 40 along either one of the x-axis or the y-axis (e.g., left/right or forward/backward). Likewise, the desired drill string 28 feed speed and direction may be increased, stopped, or reversed by moving the joystick 40 along the other of the x-axis or the y-axis (e.g., left/right or forward/backward). Further, in the drill lock mode, joystick 40 may be used to control both the rotation speed and feed speed at one time. For example, when joystick 40 is moved into a quadrant of the Cartesian coordinate system (such that joystick 40 includes a non-zero x-coordinate and y-coordinate), controller 104 may control hydraulic valves 32 of rotary head 26 and hydraulic valves 36 of hydraulic cylinder 34 at one time to modify rotation speed and feed speed at the same time.

INDUSTRIAL APPLICABILITY

The disclosed aspects of drill lock control system 100 of the present disclosure may be used in any mobile drilling machine 10, such as a blasthole drill machine to set, lock, and modify desired drill string 28 rotation speed and drill string 28 feed speed.

Figure 4:
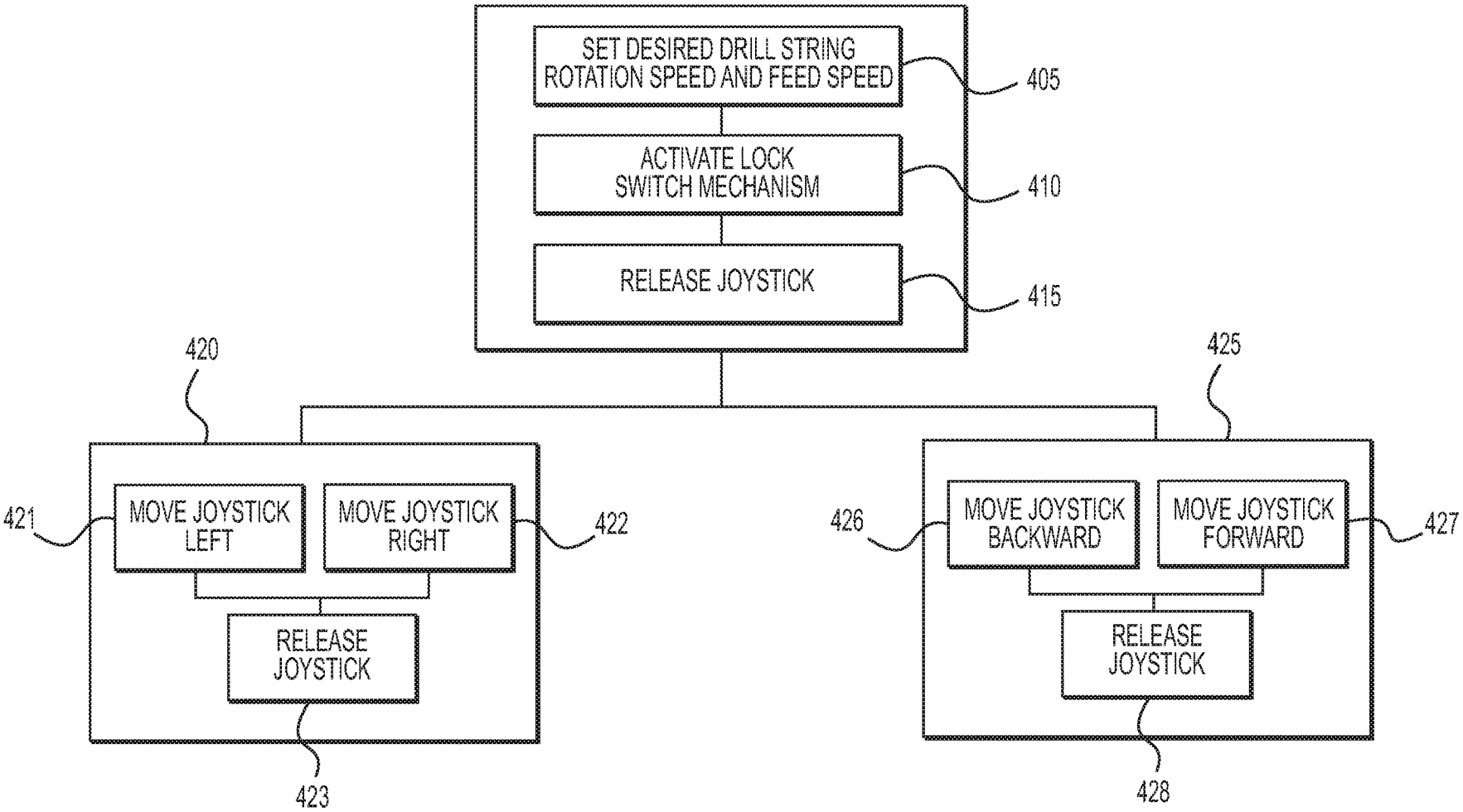
FIG. 4 provides a flowchart depicting an exemplary operation of the drill control system of FIGS. 1 and 3.

FIG. 4 provides a flowchart depicting an exemplary operation of the drill lock control system 100 of mobile drilling machine 10. An initial step 405 includes a user, or operator, setting a desired drill string 28 rotation speed and drill string 28 feed speed. The desired drill string 28 rotation speed and drill string 28 feed speed may be set by moving a respective joystick 40 along the x-axis and y-axis, as described above. As such, the controller 104 may receive a current desired drill string 28 rotation speed and drill string 28 feed speed information from the joystick 40. When the desired drill string 28 rotation speed and drill string 28 feed speed is set, the flowchart may advance to a step 410 that includes the user activating the lock switch mechanism 44 to enter a drill lock mode. Activating the lock switch mechanism 44 may configure the controller 104 to lock the current desired drill string 28 rotation speed and drill string 28 feed speed. Once the current desired drill string 28 rotation speed and drill string 28 feed speed is locked, the flow chart may advance to a step 415 that includes the user releasing the joystick 40. Releasing the joystick 40 after locking the current desired drill string 28 rotation speed and drill string 28 feed speed, the joystick 40 may be moved back to the neutral position (0,0) while maintaining the locked current desired drill string 28 rotation speed and drill string 28 feed speed.

After locking the current desired drill string 28 rotation speed and drill string 28 feed speed, the flowchart may proceed to either a step 420 for modifying one of the drill string 28 rotation speed or drill string 28 feed speed or a step 425 for modifying the other of the drill string 28 rotation speed or drill 28 feed speed. Under step 420, the flowchart may include a step 421 for moving the joystick 40 left along the x-axis and/or a step 422 for moving the joystick 40 right along the x-axis. In the exemplary embodiment, in step 421, moving the joystick 40 left along the x-axis may increase the drill string 28 rotation speed. In step 422, moving the joystick 40 right along the x-axis may decrease the drill string 28 rotation speed. In a step 423, when the user has modified the drill string 28 rotation speed or the drill string 28 feed speed to a new desired drill string 28 rotation speed or new desired drill string 28 feed speed, the user may release the joystick 40 back to the neutral position (0,0).

Under step 425, the flowchart may include a step 426 for moving the joystick 40 backward along the y-axis and/or a step 427 for moving the joystick 40 forward along the y-axis. In step 426, if the user desires to increase the drill string 28 feed speed, the user may move the joystick 40 backward along the y-axis. In the exemplary embodiment, in step 427, moving the joystick 40 backward along the y-axis may increase the drill string 28 feed speed while the drill string 28 is being pulled-down. In step 428, moving the joystick 40 forward along the y-axis may stop or reverse the drill string 28 feed speed, such that the drill string 28 is hoisted up. In a step 428, when the user has modified the drill string 28 feed speed or drill string 28 rotation speed to a new desired drill string 28 feed speed or new desired drill string 28 rotation speed, the user may release the joystick 40 back to the neutral position (0,0).

When the operator desires to exit the drill lock mode, the flowchart may advance to a step that includes the user activating the lock switch mechanism 44 again to terminate (i.e. end) the drill lock mode. Activating the lock switch mechanism 44 a second time may configure the controller 104 to unlock the current drill string 28 rotation speed and drill string 28 feed speed. Thus, joystick 40 may re-enter a normal drill mode such that the operator may resume a normal operation of drilling machine 10.

Such a drill lock control system 100 of the present disclosure may assist in maintaining a desired drill string 28 rotation speed and drill string 28 feed speed. For example, the disclosed system 100 may allow release of the joystick 40 during extended drilling operation time. The disclosed system 100 further allows the set command to be easily adjusted by movement of the joystick 40. Such a system 100 may create an intuitive operator interface, may enable use of lower cost joysticks 40, and may allow more autonomy and remote control of the system 100. Thus, the drill lock control system 100 of the present disclosure may help to avoid operator fatigue during extended drilling operations.

It will be apparent to those skilled in the art that various modifications and variations can be made to the disclosed system without departing from the scope of the disclosure. Other embodiments of the disclosure will be apparent to those skilled in the art from consideration of the specification and practice of the invention disclosed herein. For example, any orientation of movement of joystick 40 may be used to control hydraulic valves 32, 36 for controlling desired drill string 28 rotation speeds and desired drill string 28 feed speeds of rotary head 26. It is intended that the specification and examples be considered as exemplary only, with a true scope and spirit of the invention being indicated by the following claims.

What is claimed is:

1. A mobile drilling machine, comprising:

a drilling mast including a mast frame;

a rotary head movably mounted on the mast frame, the rotary head controllable to rotate a drill string at a desired drill string rotation speed, wherein the rotary head is further controllable to move up and down the mast frame at a desired drill string feed speed;

a joystick movable to control the desired drill string rotation speed and the desired drill string feed speed of the rotary head; and a controller configured to:

receive a current desired drill string rotation speed and drill string feed speed information from the joystick; and lock the current desired drill string rotation speed and the desired drill string feed speed upon activation of a switch mechanism.

2. The mobile drilling machine of claim 1, wherein the joystick is movable in a left and right direction corresponding to an x-axis, wherein the joystick is movable in a forward and backward direction corresponding to a y-axis, the y-axis being orthogonal to the x-axis, and the switch mechanism is located on the joystick.

3. The mobile drilling machine of claim 2, wherein the desired drill string rotation speed is selectable by moving the joystick along one of the x-axis or the y-axis, and wherein the desired drill string feed speed is selectable by moving the joystick along the other of the x-axis or the y-axis.

4. The mobile drilling machine of claim 3, wherein when locked, the drill string rotation speed and drill string feed speed remain at the locked current desired drill string rotation speed and the desired drill string feed speed if the joystick is returned to a neutral position.

5. The mobile drilling machine of claim 4, wherein when locked, the drill string rotation speed is selectively increased or decreased by moving the joystick along the one of the x-axis or y-axis, and wherein the drill string feed speed is selectively increased, stopped, or reversed by moving the joystick along the other of the x-axis or y-axis.

6. The mobile drilling machine of claim 5, wherein the drill string rotation speed is selectively increased or decreased by moving the joystick in the left or right direction along the x-axis, and wherein the drill string feed speed is selectively increased, stopped, or reversed by moving the joystick in the forward or backward direction along the y-axis.

7. The mobile drilling machine of claim 5, wherein the drill string rotation speed is selectively increased by moving the joystick in a first direction and the drill string rotation speed is selectively decreased by moving the joystick in a second direction opposite the first direction, and wherein the drill string feed speed is selectively increased by moving the joystick in a third direction and the drill string feed speed is selectively stopped, or reversed by moving the joystick in a fourth direction opposite the third direction, the third direction and fourth direction being orthogonal to the first direction and the second direction.

8. The mobile drilling machine of claim 5, wherein the drill string rotation speed is selectively increased or decreased in incremental steps when the joystick is moved along the one of the x-axis or the y-axis, and wherein the drill string feed speed is selectively increased in incremental steps when the joystick is moved along the other of the x-axis or the y-axis.

9. The mobile drilling machine of claim 1, wherein the controller is further configured to:

unlock the current drill string rotation speed and the drill string feed speed upon another activation of the switch mechanism.

10. The mobile drilling machine of claim 1, wherein the joystick is movable in an alternative mode to also control a movement of the mobile drilling machine along a ground surface.

11. A method of controlling a rotary head of a mobile drilling machine to rotate a drill string at desired drill string rotation speeds and to move the rotary head up and down a mast frame at desired drill string feed speeds, the method comprising:

receiving a current desired drill string rotation speed and drill string feed speed information from a joystick of the mobile drilling machine; and locking the current desired drill string rotation speed and the desired drill string feed speed upon activation of a switch mechanism.

12. The method of claim 11, wherein the joystick is movable in a left and right direction corresponding to an x-axis, wherein the joystick is movable in a forward and backward direction corresponding to a y-axis, the y-axis being orthogonal to the x-axis; and the switch is located on the joystick.

13. The method of claim 12, wherein when locked, the drill string rotation speed and drill string feed speed remain at the locked current desired drill string rotation speed and the desired drill string feed speed if the joystick is returned to a neutral position.

14. The method of claim 13, wherein when locked, the drill string rotation speed is selectively increased or decreased by moving the joystick along the one of the x-axis or y-axis, and wherein the drill string feed speed is selectively increased, stopped, or reversed by moving the joystick along the other of the x-axis or y-axis.

15. The method of claim 14, wherein the drill string rotation speed is selectively increased or decreased by moving the joystick in the left or right direction along the x-axis, and wherein the drill string feed speed is selectively increased, stopped, or reversed by moving the joystick in the forward or backward direction along the y-axis.

16. The method of claim 14, wherein the drill string rotation speed is selectively increased by moving the joystick in a first direction and the drill string rotation speed is selectively decreased by moving the joystick in a second direction opposite the first direction, and wherein the drill string feed speed is selectively increased by moving the joystick in a third direction and the drill string feed speed is selectively stopped or reversed by moving the joystick in a fourth direction opposite the third direction, the third direction and fourth direction being orthogonal to the first direction and the second direction.

17. The method of claim 14, wherein the drill string rotation speed is selectively increased or decreased in incremental steps when the joystick is moved along the one of the x-axis or the y-axis, and wherein the drill string feed speed is selectively increased, stopped, or reversed in incremental steps when the joystick is moved along the other of the x-axis or the y-axis.

18. The method of claim 11, further comprising:

unlocking the current drill string rotation speed and the drill string feed speed upon another activation of the switch mechanism.

19. The mobile drilling machine of claim 11, wherein the joystick is movable in an alternative mode to also control a movement of the mobile drilling machine along a ground surface.

20. A mobile drilling machine, comprising:

a drilling mast including a mast frame;

a rotary head movably mounted on the mast frame, the rotary head controllable to rotate a drill string at desired drill string rotation speeds, wherein the rotary head is further controllable to move up and down the mast frame at desired drill string feed speeds;

a joystick movable to control the desired drill string rotation speeds and the desired drill string feed speeds of the rotary head, wherein the joystick is movable in a left and right direction corresponding to an x-axis and movable in a forward and backward direction corresponding to a y-axis; and a controller configured to:

receive a current desired drill string rotation speed and drill string feed speed information from the joystick; and lock the current desired drill string rotation speed and the desired drill string feed speed upon activation of a switch mechanism, wherein when locked, the drill string rotation speed and drill string feed speed remain at the locked current desired drill string rotation speed and the desired drill string feed speed as the joystick is returned to a neutral position, and wherein when locked, the drill string rotation speed is selectively increased or decreased by moving the joystick along the one of the x-axis or y-axis, and the drill string feed speed is selectively increased, stopped, or reversed by moving the joystick along the other of the x-axis or y-axis.

* * * * *